US010137360B2

(12) United States Patent
Sciandra

(10) Patent No.: US 10,137,360 B2
(45) Date of Patent: Nov. 27, 2018

(54) TABLETOP DISC GAME ASSEMBLY

(71) Applicant: Kan Jam LLC, Williamsville, NY (US)

(72) Inventor: Charles C. Sciandra, Wheatfield, NY (US)

(73) Assignee: Wild Sales, LLC, Westfield, IN (US)

( * ) Notice: Subject to any disclaimer, the term of this patent is extended or adjusted under 35 U.S.C. 154(b) by 656 days.

(21) Appl. No.: 14/460,742

(22) Filed: Aug. 15, 2014

(65) Prior Publication Data

US 2016/0045819 A1 Feb. 18, 2016

(51) Int. Cl.
*A63F 9/02* (2006.01)
*A63B 67/06* (2006.01)
(Continued)

(52) U.S. Cl.
CPC ..... *A63F 9/0204* (2013.01); *A63F 7/0017* (2013.01); *A63F 7/0668* (2013.01);
(Continued)

(58) Field of Classification Search
CPC ..... A63F 9/0204; A63F 7/0017; A63F 2007/4068; A63F 7/249; A63F 7/0668; A63F 2007/2445; A63B 67/06
USPC ..... 273/353, 441, 398–406, 108, 108.1, 273/129 W, 129 L, 317, 317.1, 317.3, 273/352, 108.5
See application file for complete search history.

(56) References Cited

U.S. PATENT DOCUMENTS 265,836 A * 10/1882 Lindner ..... G09F 1/00 220/690
432,170 A * 7/1890 Scott ..... A63F 7/0628 273/317.2

(Continued)

FOREIGN PATENT DOCUMENTS

CA 2027388 A 4/1992
WO 9813110 4/1998

OTHER PUBLICATIONS

Kan-Jam, Aug. 1, 2013, "KanJam Illuminate Glow in the Dark Accessory kit", Amazon.com, [online], Available from: http://wvvw.amazon.com/Kan-Illuminate-Glow-Dark-Accessory/dp/B008AIOB48fref=cm_ cr _pr_ producUop D [Accessed Jan. 14, 2015].

(Continued)

*Primary Examiner* — Sebastiano Passaniti
(74) *Attorney, Agent, or Firm* — Simpson & Simpson, PLLC

(57) ABSTRACT

A tabletop disc game assembly including at least one target including a sheet of a material, the sheet including a first side edge, a second side edge displaced from and substantially parallel with the first side edge, a fastening means operatively arranged to abut the first side edge against the second side edge, a substantially planar top side edge connecting the first side edge and the second side edge and a substantially planar bottom side edge displaced from and substantially parallel with the top side edge, the bottom side edge including a cut out. When the sheet of material is fastened, the (Continued)

target is operatively arranged to be positioned upright on a flat surface and to receive a projectile. A flexible member is used to slide or launch the projectile toward an opposing facing target for points; the first team to earn a pre-determined amount of points wins.

10 Claims, 10 Drawing Sheets

(51) Int. Cl.

| | |
|---|---|
| ***A63F 7/00*** | (2006.01) |
| ***A63F 7/06*** | (2006.01) |
| *A63F 7/24* | (2006.01) |
| *A63F 7/40* | (2006.01) |

(52) U.S. Cl.
CPC ..... *A63B 67/06* (2013.01); *A63F 7/249* (2013.01); *A63F 2007/2445* (2013.01); *A63F 2007/4068* (2013.01)

(56) References Cited

U.S. PATENT DOCUMENTS 1,114,523 A 10/1914 Revell
1,680,356 A * 8/1928 Yaraus ..... A63F 7/0668 273/108.5
1,693,277 A * 11/1928 Hustwick ..... A63F 3/00041 273/247
1,712,073 A * 5/1929 Fowler ..... A63F 7/0612 273/317.3
1,864,500 A * 6/1932 Livingston ..... A63F 7/0628 273/317.2
2,069,514 A 2/1937 Wylie
2,183,107 A * 12/1939 Savage ..... A63F 9/0204 273/353
2,235,933 A * 3/1941 Aarne Laine ..... A63F 7/02 273/353
2,261,448 A * 11/1941 Petersen ..... A63F 7/0612 273/244
3,208,478 A * 9/1965 Baines ..... E02B 11/005 138/162
3,350,097 A 10/1967 Chevrette et al.
3,359,678 A 12/1967 Headrick
3,403,907 A 10/1968 Keller
3,469,844 A 9/1969 Sindelar
3,856,298 A * 12/1974 Frantti ..... A63B 63/00 273/127 R
3,881,728 A 5/1975 Martyn
4,114,885 A 9/1978 Morrow
4,167,267 A * 9/1979 Romero ..... A63F 7/0017 273/353
4,204,682 A 5/1980 Brown
4,261,568 A * 4/1981 Such ..... A63F 7/0668 273/108.5
4,335,881 A 6/1982 Warehime
4,373,734 A 2/1983 Frank
4,762,323 A 8/1988 Blagg
4,775,152 A * 10/1988 Roehl ..... A63F 7/0668 273/108.1
4,936,590 A 6/1990 Palmer
4,968,041 A 11/1990 Calvo
4,982,966 A 1/1991 Teafatiller
5,048,845 A 9/1991 Dunipace
5,056,679 A * 10/1991 Lonczak ..... B65F 1/00 141/316
5,056,797 A 10/1991 Hockert et al.
5,123,656 A 6/1992 Green
D333,896 S 3/1993 Starkweather
5,242,164 A * 9/1993 Nicoll ..... A63F 7/0668 273/108.5
5,354,067 A 10/1994 Junemann
5,372,269 A * 12/1994 Sutton ..... B65D 3/04 220/4.09
5,382,028 A 1/1995 Sciandra et al.
5,403,016 A * 4/1995 Kudo ..... A63F 9/02 273/353
5,419,566 A 5/1995 Byrd
5,451,050 A 9/1995 Charles
5,709,385 A 1/1998 Fitzpatrick et al.
5,752,703 A 5/1998 Wong
5,893,563 A 4/1999 Buller
5,896,693 A 4/1999 Ray
D417,616 S * 12/1999 Conway ..... D9/414
6,341,780 B1 1/2002 Pant et al.
6,889,982 B1 5/2005 Gove
6,971,940 B2 12/2005 Cohen et al.
7,134,662 B2 11/2006 Menendez
7,854,528 B2 12/2010 Segretto et al.
D639,519 S * 6/2011 Gomez ..... D34/6
8,348,713 B2 1/2013 Groft et al.
8,573,429 B2 * 11/2013 Hawkins ..... B65D 25/34 211/128.1
8,807,569 B1 8/2014 Davis
8,967,624 B1 3/2015 Ingle
2002/0175469 A1 11/2002 Kessler, Jr. et al.
2004/0221885 A1 11/2004 Zheng
2006/0103072 A1 5/2006 Mercieca
2008/0111312 A1 5/2008 Longo et al.
2009/0069129 A1 3/2009 McCarthy
2010/0164175 A1 7/2010 Buchanan
2010/0317470 A1 12/2010 Cea et al.
2011/0156348 A1 6/2011 Ruiz
2012/0065004 A1 3/2012 Blackwell
2012/0319354 A1 * 12/2012 Fusco ..... A63B 63/08 273/398
2014/0183823 A1 7/2014 Deming et al.
2015/0061225 A1 3/2015 Sciandra

OTHER PUBLICATIONS

Kan-Jam, Jul. 21, 2009, "Kan Jam Ultimate Disc Game" Amazon.com, [online], Available from http://wvvw.amazon.com Kan-Jam 102863-Kan-Jam-Game/dp/BOOIRJ4Q2G/ref=cm_cr _pr product_top [Accessed Jan. 14, 2015].

* cited by examiner

W
L
40
H

40
W
H

40
W
H

L
40
H

L
40
H

W
40
L

W
40
L

TABLETOP DISC GAME ASSEMBLY

FIELD OF THE INVENTION

The invention relates generally to tabletop games and, more specifically, to tabletop games involving targets and at least one disc which is arranged to be launched or slid through at least one opening in the targets.

BACKGROUND OF THE INVENTION

Tabletop games are games that are played on the top of a table or some other flat surface, for example, board games, dice games and card games. One such typical tabletop game, known as sharpshooter, involves a single target placed at one edge of a table. The object of the game is for the players to "shoot" or flick a marble using a Popsicle® type stick at the target to earn points. The game is described by the Walt Disney Company through the on-line division called Spoonful®.

Another typical tabletop game involves two soccer goals placed at opposite sides of a table. The object of the game is for each player to "kick" a paper ball across the table toward his/her opponent's goal, using only his/her fingers, to score on their opponent. The game is described by the Walt Disney Company through the on-line division called Spoonful®.

U.S. Pat. No. 1,114,523 (A. H. Revell) describes a tabletop game. The object of the game is to land as many cards as possible within the receptacle by sailing or gliding the cards through the air over a distance. The receptacle is formed by bending a flexible material into a cylindrical form and attaching the ends together. The upper edge of the receptacle is convex or conical such that when the receptacle is set up as a target the rear wall serves as a deflector for the cards thrown to the receptacle. Unfortunately, the game described in the Revell reference does not provide a device for launching projectiles.

U.S. Pat. No. 5,752,703 (Wong) describes a projectile-target game of skill. The Wong reference discloses a tabletop game including a container or cup, a game board, a game piece, and a ball or some other projectile. The game piece is a flexible slat with a central spring and a bail. A ball may be placed into the bail of the game piece so that when the slat is flicked, the ball is propelled toward the upright cup/board assembly. Alternatively, the game piece may be used to swat a ball toward the cup/board assembly on its side. Unfortunately, the container of the game cannot be disassembled and can become easily deformed.

U.S. Pat. No. 5,709,385 (Fitzpatrick et al.) describes a sports board game including a rotatable platform and a plurality of interchangeable game boards. The game also includes game pieces and goals around the perimeter of the game board. The game pieces can be slid or launched. To launch the game pieces, portable slotted ramps are provided. Unfortunately, the game disclosed in Fitzpatrick is complex and bulky.

Therefore, there is a long-felt need for a tabletop game that features targets which are lightweight, easy to maneuver, assemble and disassemble, at least one lightweight disc, and a lightweight device for launching or sliding the at least one lightweight disc into the lightweight targets.

BRIEF SUMMARY OF THE INVENTION

The invention is a tabletop disc game assembly including a first target, the target formed from a sheet of a material, the sheet including a first side edge, a second side edge displaced from and substantially parallel with the first side edge, a fastening means operatively arranged to abut the first side edge against the second side edge, a substantially planar top side edge connecting the first side edge and the second side edge, a substantially planar bottom side edge displaced from and substantially parallel with the top side edge, the bottom side edge including a cut out, a second target substantially similar to the first target, a disc operatively arranged to be received within the first or second targets and a flexible member arranged to direct the disc into the first or second targets. When the targets are fastened and operatively arranged to be positioned upright on a flat surface, the targets are operatively arranged to receive the disc.

The invention also includes a tabletop disc game assembly including at least one target including a sheet of a material, the sheet including a first side edge, a second side edge displaced from and substantially parallel with the first side edge, a fastening means operatively arranged to abut the first side edge against the second side edge, a substantially planar top side edge connecting the first side edge and the second side edge and a substantially planar bottom side edge displaced from and substantially parallel with the top side edge, the bottom side edge including a cut out. When the sheet of material is fastened, the target is operatively arranged to be positioned upright on a flat surface and to receive a projectile.

Additionally, the invention is a method of playing a disc throwing game by a first team and a second team, comprising the steps of (A) assembling at least one target to be positioned upright on a flat surface and to receive a projectile, (B) positioning a player of the first team a distance from the at least one target, (C) sliding the projectile using a flexible member across the flat surface toward the at least one target or launching the projectile using the flexible member toward the at least one target by the player of the first team, (D) positioning a player of the second team a distance from the at least one target, (E) sliding the projectile using the flexible member across the flat surface toward the at least one target or launching the projectile using the flexible member toward the at least one target by the player of the second team and (F) repeating steps (C) through (E) in alternating fashion until the first team or the second team earns a predetermined amount of points.

Accordingly, it is a primary object of the invention to have a tabletop game that is lightweight, easy to maneuver, assemble, and disassemble. It is a further object of the invention to have a tabletop game that is easy to package and transport.

Still another object of the invention to have a tabletop game that includes receptacles having an open top and at least one cut out for receiving a projectile or a disc.

These and other objects, features, and advantages of the present invention will become apparent in view of the following detailed description in view of the drawings and appended claims.

BRIEF DESCRIPTION OF THE DRAWINGS

The nature and mode of operation of the present invention will now be more fully described in the following detailed description of the invention taken with the accompanying figures, in which.

DETAILED DESCRIPTION OF THE INVENTION

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspect. The present invention is intended to include various modifications and equivalent arrangements within the spirit and scope of the appended claims.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

Figure 1:
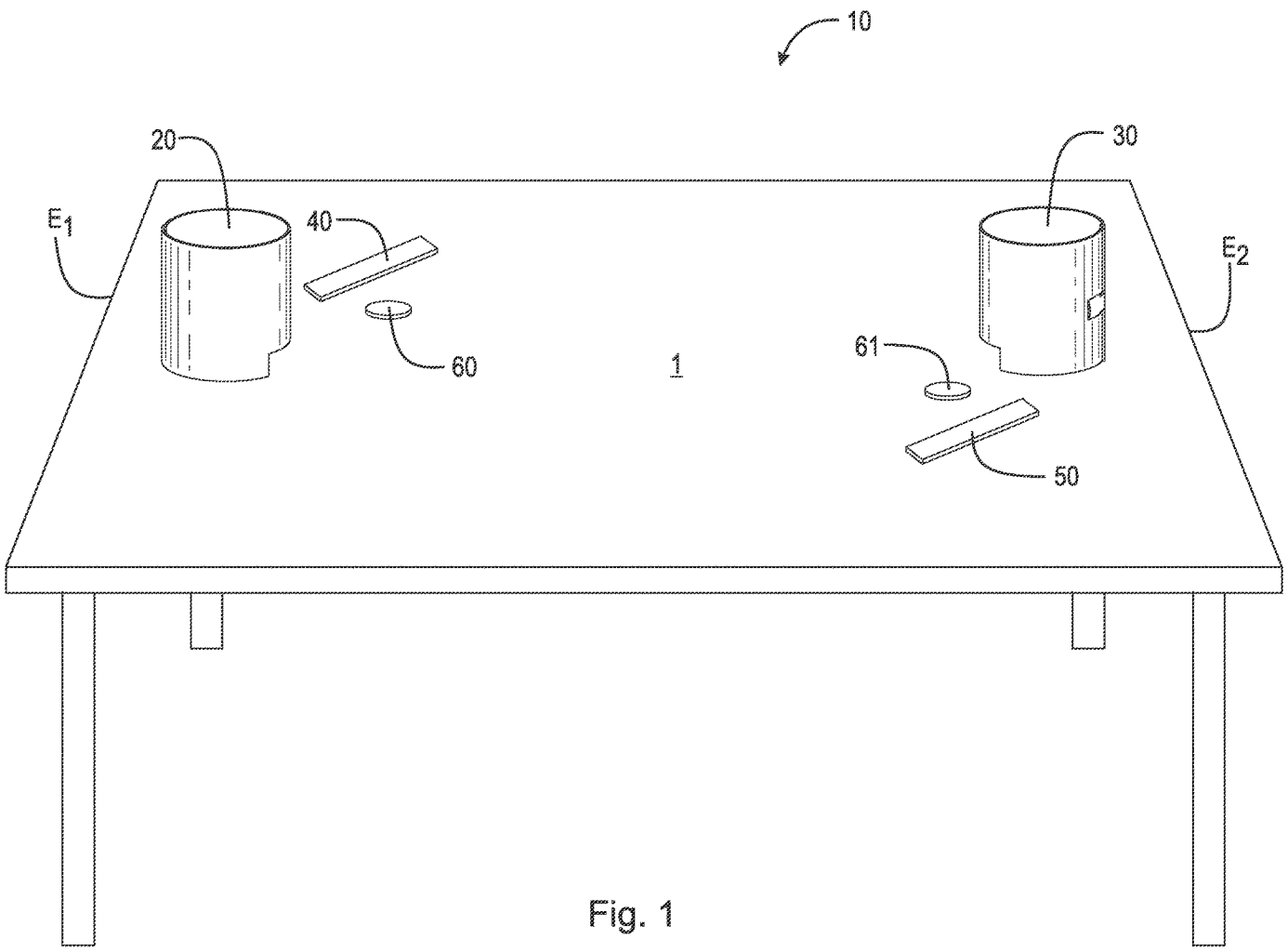
FIG. 1 is a perspective view of the disc game assembly of the invention shown atop a table.

Adverting now to the Figures, FIG. 1 shows typical table 1 supporting disc game assembly 10. It should be appreciated that any table is contemplated. Disc game assembly 10 broadly comprises first target 20, second target 30, first flexible member 40, second flexible member 50, and at least one disc 60. In a preferred embodiment, first target 20 is substantially similar to second target 30 and first flexible member 40 is substantially similar to second flexible member 50. Additionally, in a preferred embodiment, there are two discs 60 and 61. In a preferred embodiment, first target 20 is arranged atop table 1 proximate or along edge $E_1$ and second target 30 is arranged atop table 1 proximate or along edge $E_2$ opposite edge $E_1$ such that first target 20 is facing second target 30. It should be appreciated that first and second targets 20 and 30 could be arranged proximate or along any edges of table 1, respectively. Additionally, it should be appreciated that targets 20 and 30 could be arranged at opposite end points of a circular table or at opposing corners of a table diagonally.

Figure 2:
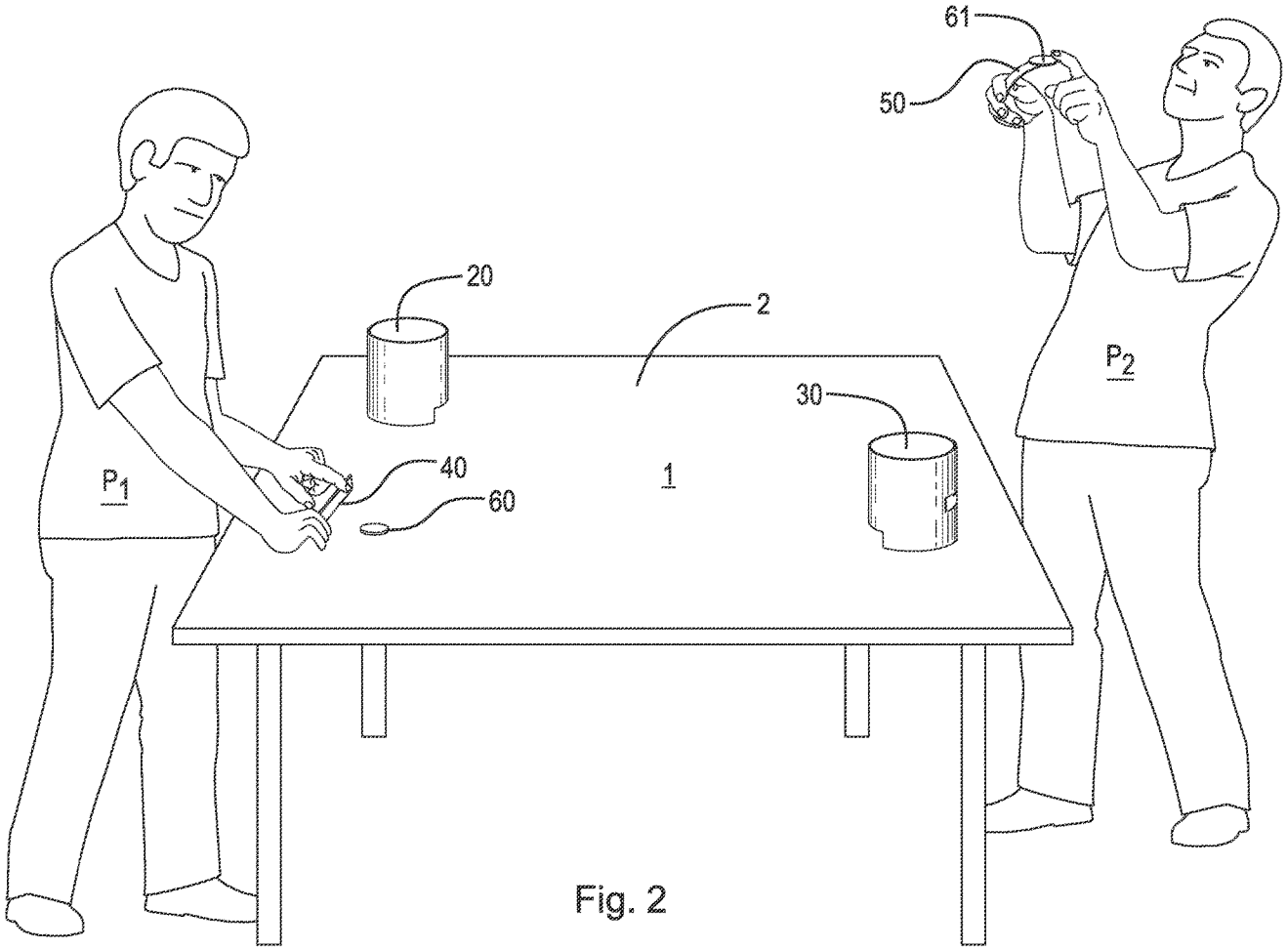
FIG. 2 is a perspective view of the disc game assembly shown in FIG. 1 with players using the game assembly.

As shown in FIG. 2, at least one player of one team stands behind first target 20 and at least one player of another team stands behind second target 30. Both players $P_1$ and $P_2$ are facing at least one target. It should be appreciated that any number of players can form the teams. In the preferred embodiment shown, player $P_1$ uses flexible member 40 to glide disc 60 along top surface 2 of table 1. Player $P_2$ uses flexible member 50 to launch disc 61 through the air toward first target 20. It should be appreciated that players $P_1$ and $P_2$ can use either method of gliding or launching to project the discs 60 and/or 61.

Figure 3B:
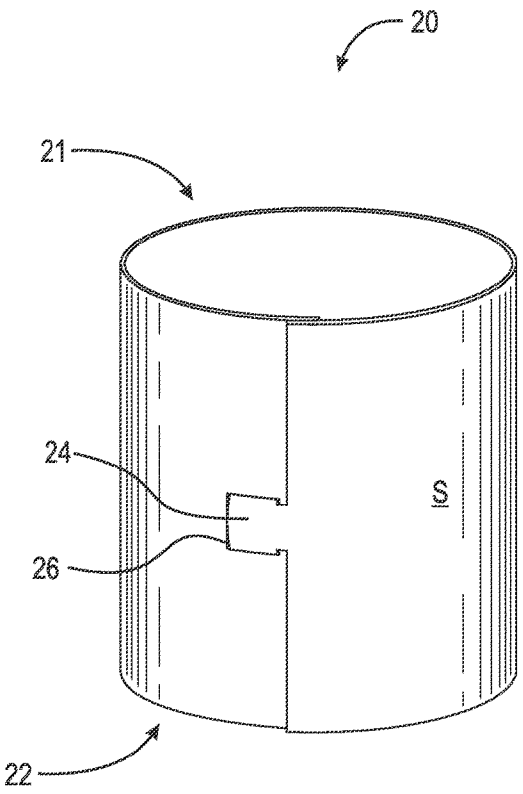
FIG. 3B is a rear perspective view of the target of the disc game assembly shown in FIG. 3A.
Figure 3A:
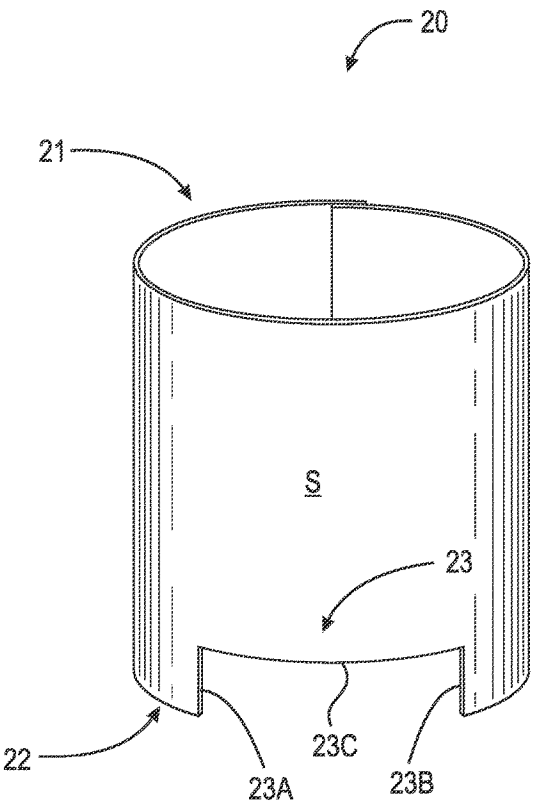
FIG. 3A is a front perspective view of a target of the disc game assembly of the invention.

FIG. 3A shows a front perspective view of first target 20. Since second target 30 is substantially similar to first target 20, the discussion regarding first target 20 applies to second target 30. As shown in FIG. 3A, first target 20, in a preferred embodiment, is formed of a sheet of material. Preferably, the material is high density polyethylene (HDPE). However, it should be appreciated that the material could be any suitable alternative which is flexible and lightweight. Preferably, target 20 is operatively arranged to form an upright substantially cylindrical structure having open top 21 and open bottom 22. In a preferred embodiment, target 20 includes cut out 23. Cut out 23 is arranged within sidewall S of target 20. In a preferred embodiment, cut out 23 is three-sided with an open edge along the plane of open bottom 22. Preferably, cut out 23 includes side 23A, side 23B, and side 23C where side 23A is parallel to side 23B and side 23C is perpendicular to sides 23A and 23B. Additionally, preferably, side 23C connects sides 23A and 23B. Side 23C is arranged offset from open bottom 22. It should be appreciated that cut out 23 can be any suitable shape; for example, sides 23A and 23B can be angled inward from open bottom 22. Alternatively, cut out 23 can include sides 23A and 23B without side 23C such that sides 23A and 23B form an inverted "V" shape. In a preferred embodiment, sides 23A, 23B, and 23C are linear, however it should be appreciated that any one or all of sides 23A, 23B, or 23C can be nonlinear. Additionally, it should be appreciated that cut out 23 can include additional sides. For example, cut out 23 can have four sides forming a "M" shape. Any suitable shape is contemplated so long as at least one disc 60 can slide through cut out 23.

Figure 3D:
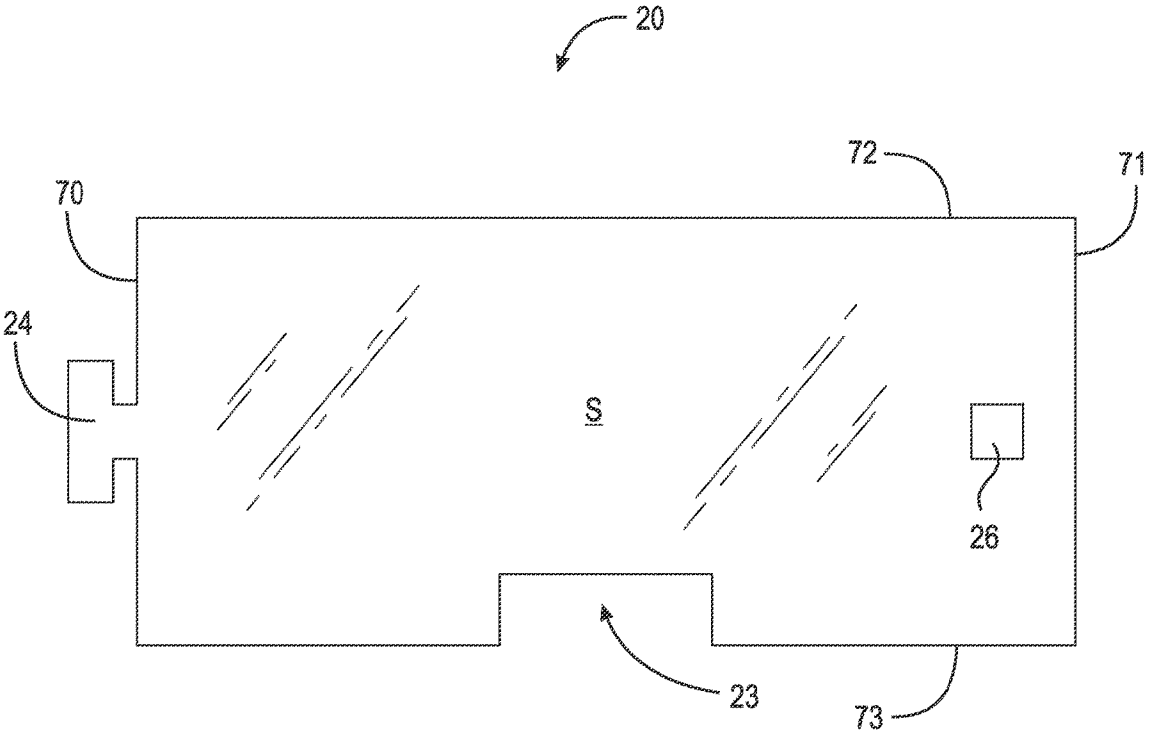
FIG. 3D is a perspective view of the target shown flattened.
Figure 3C:
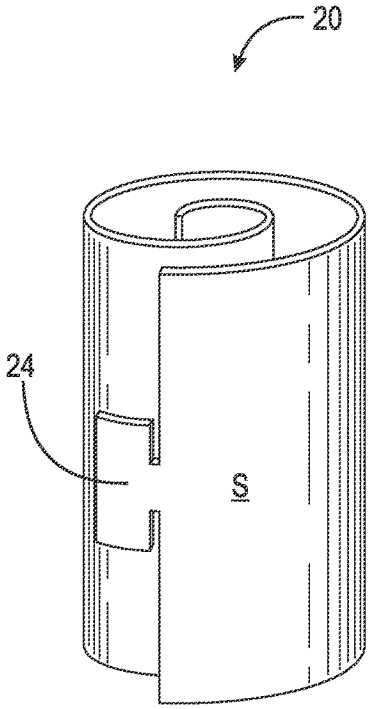
FIG. 3C is a perspective view of the target shown rolled up.

As shown in FIG. 3B, the cylindrical shape of target 20 is maintained by tab 24 and slot 26. It should be appreciated that additional tabs and additional slots can be used to hold together the edges of sidewall S. In a preferred embodiment, only tab 24 and slot 26 are used to hold together the edges of sidewall S. Furthermore, it should be appreciated that slot 26 could be divided into two spaces to receive the ends of tab 24. However, in a preferred embodiment, slot 26 is a single aperture in the shape of a quadrilateral as shown in FIG. 3D. Tab 24 and slot 26 are used to easily assemble and disassemble target 20. Tab 24 is removable from slot 26, for storage or shipping, for example. Tab 24 can be squeezed together and placed into slot 26 which is smaller than tab 24. Once tab 24 is within slot 26, tab 24 can be released and tab 24 expands behind slot 26 thereby holding the edges of sidewall S together. When tab 24 is disengaged from slot 26, target 20 can be rolled up as shown in FIG. 3C or flattened as shown in FIG. 3D. When flattened, in a preferred embodiment, target 20 is approximately 11 inches long along the top edge opposite cut out 23. Referring to FIG. 3D, in a preferred embodiment, target 20 includes side edge 70, side edge 71, substantially planar top side edge 72, and substantially planar bottom side edge 73. Side edge 70 is displaced from and substantially parallel with edge 71. Similarly, substantially planar top side edge 72 is displaced from and substantially parallel with substantially planar bottom side edge 73. Cut out 23 is arranged within substantially planar bottom side edge 73. Tab 24 and slot 26 are an example fastening means operatively arranged to cause side edges 70 and 71 to abut when tab 24 and slot 26 are fastened.

Figure 4A:
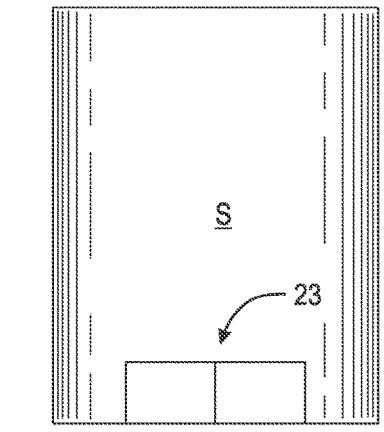
FIG. 4A is a front elevational view of the target shown in FIG. 3A.
Figure 4B:
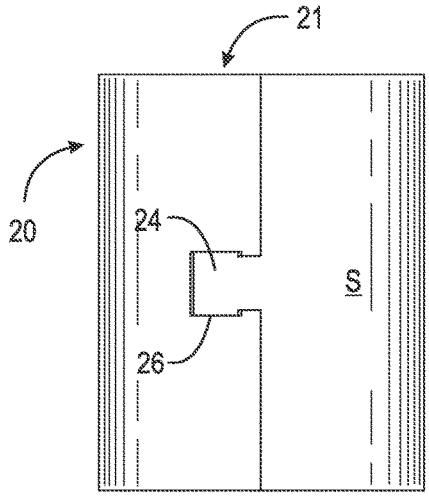
FIG. 4B is a rear elevational view of the target shown in FIG. 3A.

FIG. 4A shows a front elevational view of target 20. Cut out 23 is shown extending upwardly from open bottom 22. Through cut out 23, the edges of sidewall S are shown secured together behind cut out 23. FIG. 4B shows a rear elevational view of target 20. Tab 24 is shown secured to slot 26. In a preferred embodiment, the distance between open top 21 and open bottom 22 is approximately 5 inches. However, it should be appreciated that the distance can be increased or decreased as desired.

Figure 4C:
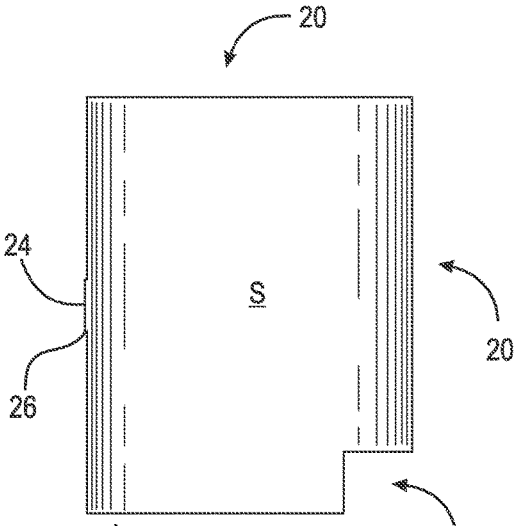
FIG. 4C is a left side elevational view of the target shown in FIG. 3A.
Figure 4D:
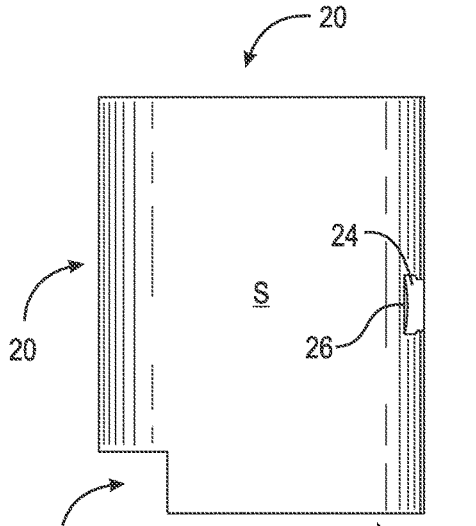
FIG. 4D is a right side elevational view of the target shown in FIG. 3A.

A left side elevational view of target 20 is shown in FIG. 4C. Slot 26 is shown receiving tab 24. From the right side elevational view of target 20 shown in FIG. 4D, slot 26 is hidden underneath tab 24.

Figure 5B:
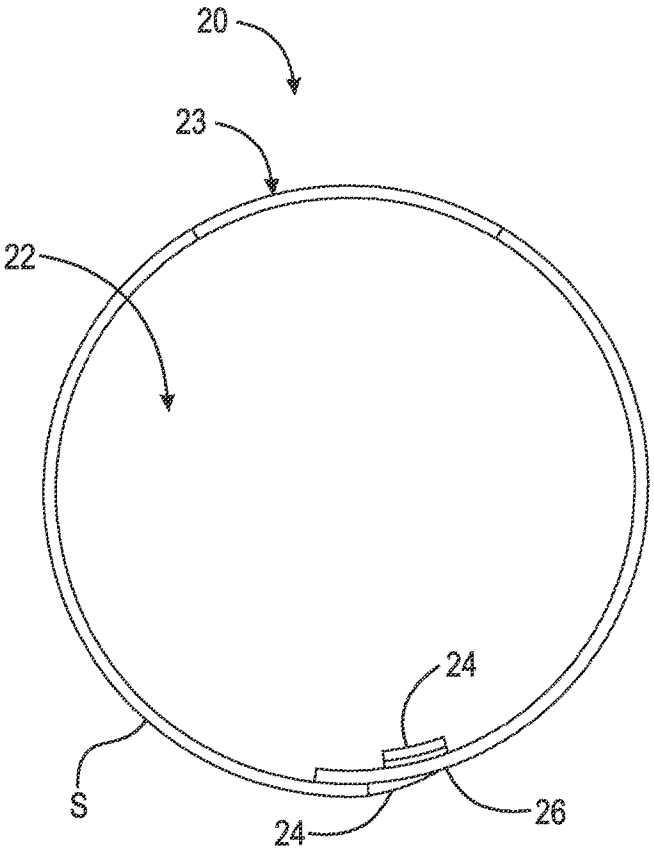
FIG. 5B is a bottom plan view of the target shown in FIG. 4A.
Figure 5A:
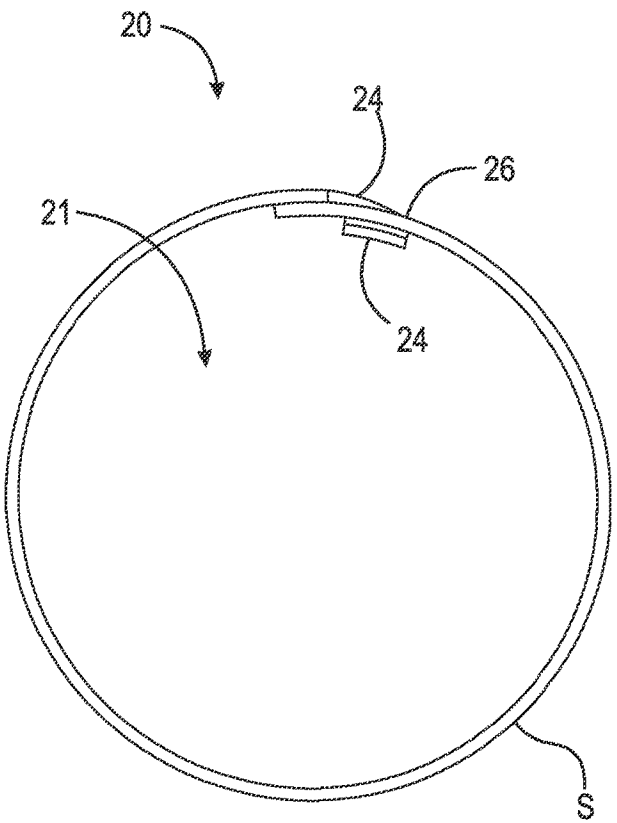
FIG. 5A is a top plan view of the target shown in FIG. 4A.

Open top 21 is shown in FIG. 5A. From the top plan view shown in FIG. 5A, the tab-side edge of sidewall S is shown radially outward of the slot-side edge of sidewall S. FIG. 5B shows a bottom plan view of target 20. Cut out 23 is shown protruding upwards from open bottom 22. Additionally, slot-side edge of sidewall S is shown radially inward of the tab-side edge of sidewall S. Thus, it should be appreciated that when target 20 is assembled, the edges of sidewall S overlap. It should further be appreciated that target 20 can be assembled with any other suitable means. For example, the edges of sidewall S could be held together by hook and loop fastener or snaps. In a preferred embodiment, when target 20 is assembled, the diameter is approximately 3.3125 inches. However, it should be appreciated that target 20 can be made to form a smaller or larger diameter as desired.

Figures 6A, 6B, 6C, 6D, 6E, 6F, 6G:
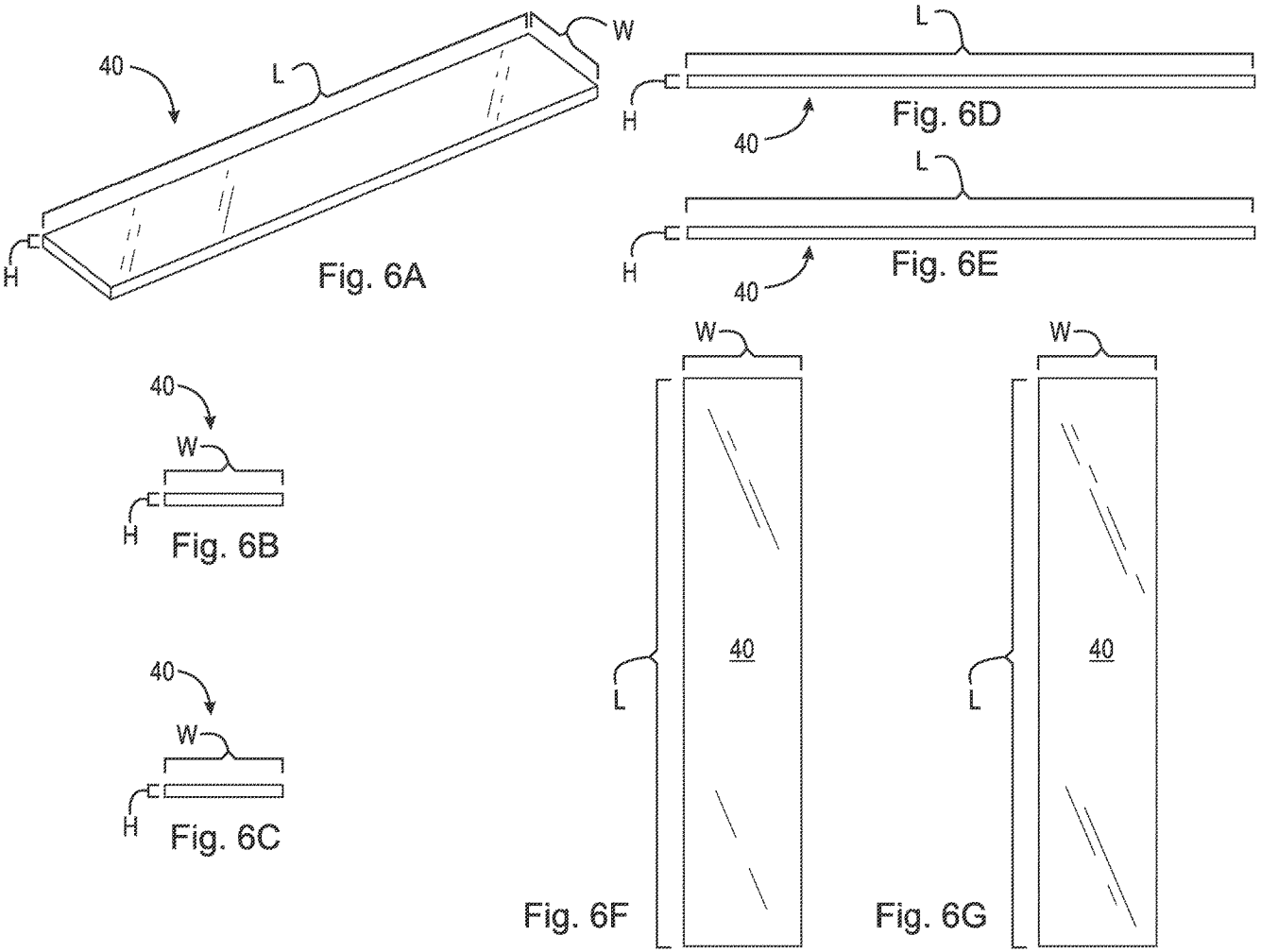
FIG. 6A is a perspective view of a flexible member of the invention.
FIG. 6B is a front elevational view of the flexible member shown in FIG. 6A.
FIG. 6C is a rear elevational view of the flexible member shown in FIG. 6A.
FIG. 6D is a left side elevational view of the flexible member shown in FIG. 6A.
FIG. 6E is a right side elevational view of the flexible member shown in FIG. 6A.
FIG. 6F is a top plan view of the flexible member shown in FIG. 6A.
FIG. 6G is a bottom plan view of the flexible member shown in FIG. 6A.

A perspective view of flexible member 40 is shown in FIG. 6A. Since second flexible member 50 is substantially similar to first flexible member 40, the discussion regarding flexible member 40 applies to second flexible member 50. Preferably, flexible member 40 is made of HDPE. However, it should be appreciated that any suitable alternative which is flexible and lightweight can be used. In a preferred embodiment, flexible member 40 has a rectangular prism shape. Additionally, it should be appreciated that the corners of flexible members 40 and 50 are rounded to avoid any injury to the players. The amount of rounding can be increased or decreased as desired. For example, the sides along width W of flexible members 40 and 50 could be completely rounded. Alternatively, the corners of flexible members 40 and 50 need not be rounded at all. In a preferred embodiment, the corners are rounded with a 1/16-inch radius rounding over bit.

FIGS. 6B and 6C show front and rear elevational views of flexible member 40, respectively. FIGS. 6D and 6E show left and right side elevational views of flexible member 40, respectively. FIGS. 6F and 6G show top and bottom plan views of flexible member 40, respectively. Flexible member 40 has length L, width W, and height H. In a preferred embodiment, width W is greater than height H and length L is greater than width W. In a preferred embodiment, width W is approximately 1 inch, height H is approximately 0.0625 inch, and length L is approximately 5 inches. However, it should be appreciated that width W, height H, and length L could be increased or decreased as desired. It should be appreciated that the surfaces of flexible member 40 shown in FIGS. 6F and 6G are substantially planar. In a preferred embodiment, the surfaces shown in FIGS. 6B, 6C, 6D, and 6E are substantially planar, however, it should be appreciated that in an alternate embodiment the surfaces shown in FIGS. 6B, 6C, 6D, and 6E could be angled or nonlinear.

Figure 7A:
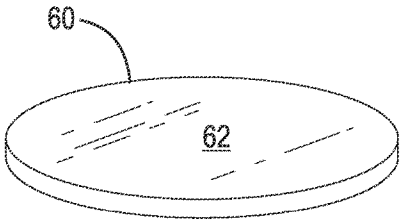
FIG. 7A is a perspective view of a disc of the invention.
Figure 7B:
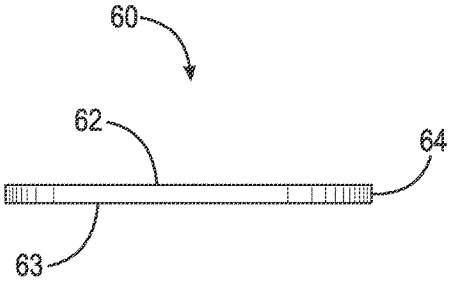
FIG. 7B is a side elevational view of the disc shown in FIG. 7A.

Disc 60 is shown in FIG. 7A. Since disc 60 is substantially similar to disc 61, the discussion regarding disc 60 applies to disc 61. Preferably, disc 60 is made of HDPE. However, it should be appreciated that any suitable alternative which is flexible and lightweight can be used. In a preferred embodiment, disc 60 is in the shape of a prism or, more particularly, in the shape of a section of a solid cylinder. As shown in FIG. 7B, disc 60 includes top surface 62, bottom surface 63 and side surface 64. Top and bottom surfaces 62 and 63 are substantially planar in a preferred embodiment. Preferably, side surface 64 is substantially perpendicular to top and bottom surfaces 62 and 63, respectively. However, it should be appreciated that side surface 64 could be angled or nonlinear.

Figure 7C:
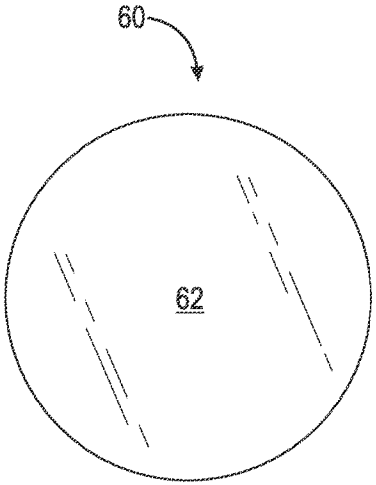
FIG. 7C is a top plan view of the disc shown in FIG. 7A.
Figure 7D:
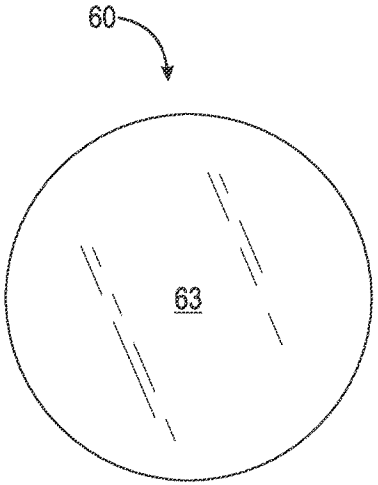
FIG. 7D is a bottom plan view of the disc shown in FIG. 7A.

From the top and bottom plan views shown in FIGS. 7C and 7D, respectively, disc 60 is substantially circular. It should be appreciated that at least top surface 62 or bottom surface 63 of disc 60 is planar such that disc 60 can glide along top surface 2 of table 1. In a preferred embodiment, disc 60 is approximately 1.75 inches in diameter, however, it should be appreciated that the diameter can be increased or decreased as desired. Additionally, in a preferred embodiment, side surface 64 of disc 60 is approximately 0.0625 inch between top surface 62 and bottom surface 63. However, side surface 64 can be thinned or thickened as desired.

Figure 8B:
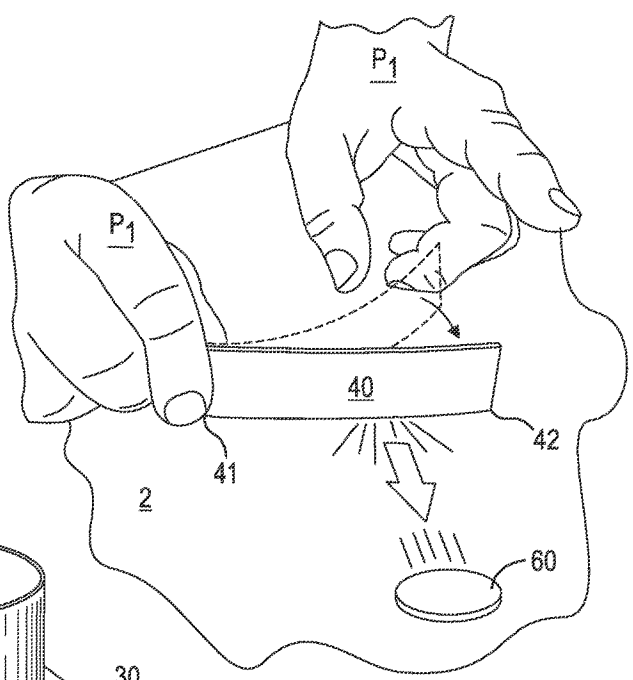
FIG. 8B is a perspective view of a player gliding the disc of the invention with the flexible member of the invention.
Figure 8A:
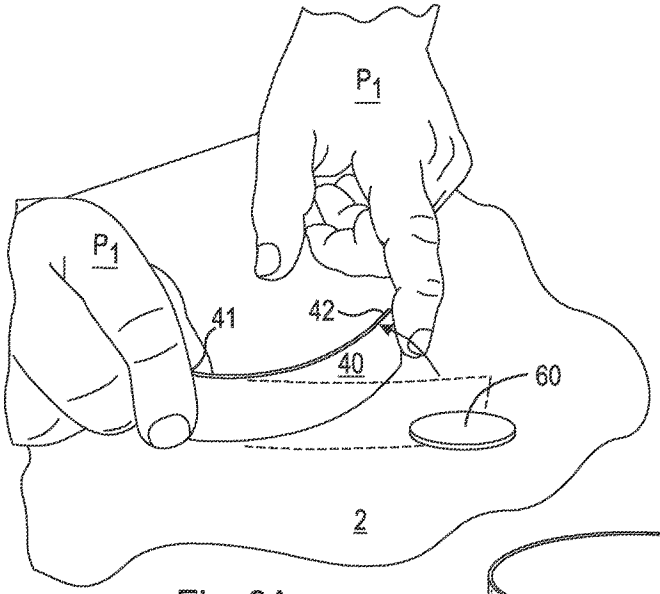
FIG. 8A is a perspective view of a player preparing to glide the disc of the invention with the flexible member of the invention.

FIG. 8A shows player $P_1$ flexing flexible member 40 to glide disc 60 along top surface 2 of table 1. While holding flexible member 40 in the vicinity of disc 60, specifically, end 41, player $P_1$ pulls end 42 of flexible member 40 in the direction shown and quickly releases end 42 to contact disc 60. As shown in FIG. 8B, as end 42 of flexible member 40 contacts disc 60, disc 60 is propelled in the direction shown.

Figure 8C:
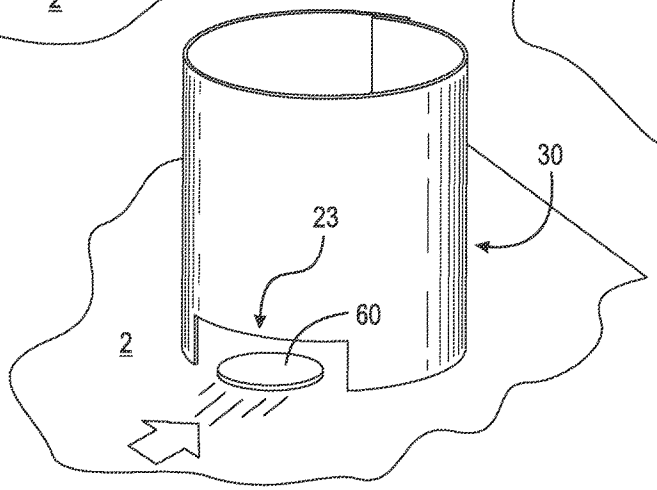
FIG. 8C is a perspective view of the disc of the invention gliding through the target of the invention.

As shown in FIG. 8C, disc 60 can be slid through cut out 23 of second target 30. It should be appreciated that ends 41 and 42 are interchangeable. Additionally, it should be appreciated that disc 60 can be slid toward second target 30 without contacting second target 30. Alternatively, disc 60 can be slid toward second target 30 and contact second target 30 without sliding through cut out 23.

Figure 9A:
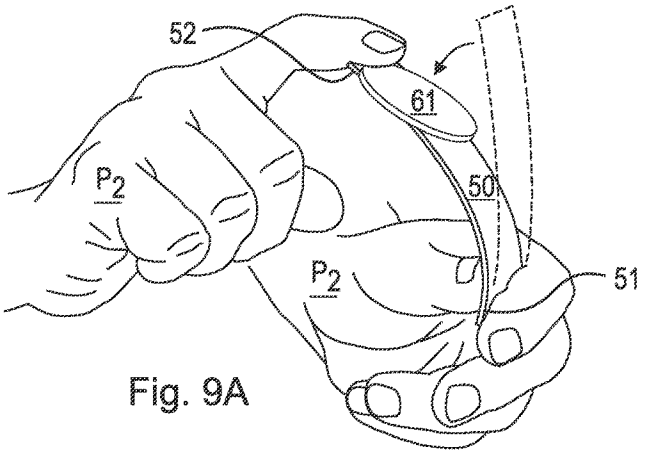
FIG. 9A is a perspective view of a player preparing to launch the disc of the invention with the flexible member of the invention.
Figure 9B:
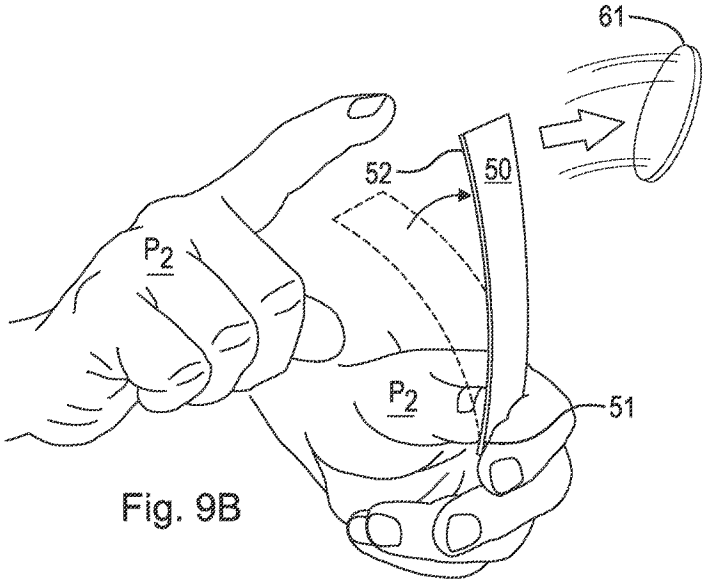
FIG. 9B is a perspective view of a player launching the disc of the invention with the flexible member of the invention; and, FIG. 9C is a perspective view of the disc of the invention landing in the target of the invention through the top opening of the target.
Figure 9C:
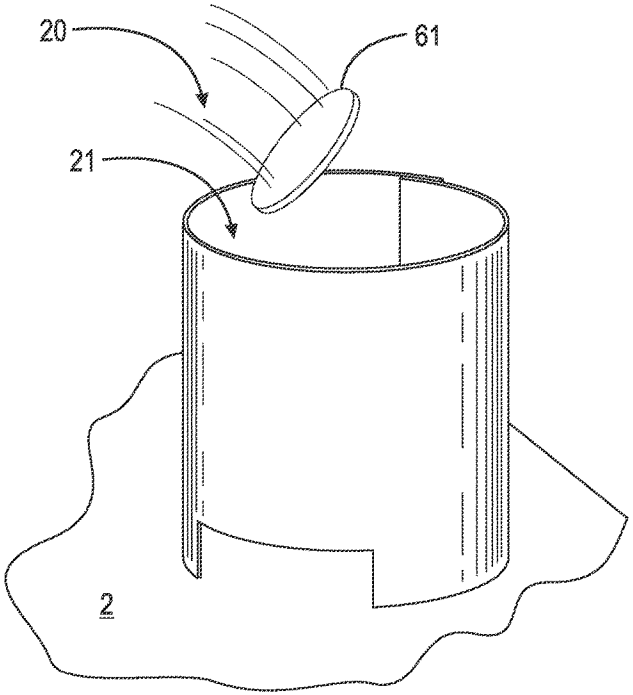

FIG. 9A is a perspective view of player $P_2$ holding end 51 of flexible member 50, positioning disc 61 proximate end 52 of flexible member 50 and pulling end 52 in the direction shown in preparation of launching disc 61 toward target 20. FIG. 9B shows player $P_2$ releasing end 52 of flexible member 50. When released, end 52 moves in the direction shown and disc 61 is launched through the air along the path shown. It should be appreciated that the path traveled by disc 61 depends on how flexible member 50 is used to launch disc 61. As shown in FIG. 9C, launched disc 61 can land in target 20 through open top 21. Alternatively, launched disc 61 can contact target 20 without landing within open top 21. Launched disc 61 can be launched and never make contact with target 20.

It should be appreciated that disc game assembly 10 can be used to play a disc throwing game. An example disc throwing game utilizing disc game assembly 10 can be played by two teams of two. However, it should be appreciated that the game can be played by teams having any number of players. A team wins by earning exactly twenty-one points. Points can be earned as follows. As discussed above, disc 60 or disc 61 can be slid along top surface 2 of table 1 toward an opposing target, for example target 30 as shown in FIG. 2. If the disc goes into the cut out of target 30, player $P_1$ earns three points for his team. If the disc hits target 30 but does not pass through the cut out of the target, player $P_1$ earns one point for his team.

Also as discussed above, disc 60 or disc 61 can be launched through the air toward an opposing target, for example target 20 as shown in FIG. 2. If the disc hits the aimed-for target, player $P_2$ earns two points for his team. If the disc enters the open top of the aimed-for target either directly or by bouncing off the aimed-for target, the game is instantly won. In other words, if any team member launches a disc in the air and the disc lands within the opposing target through the open top of the target the game is over; the team member who launched the disc earns an instant win for his or her team.

In an example embodiment of the disc throwing game, each team can designate a single shot during a game as a bonus shot. The designated bonus shot allows the team member to earn double the amount of points if successful. For example, if a team member announces his shot is deemed the bonus shot and he slides a disc into the cut out of the opposing target, instead of earning three points he would earn six points for his or her team. A one point shot would be a two point shot if designated the bonus shot. A two point shot would be a four point shot if designated the bonus shot. An instant win is still possible for a bonus shot. However, if the designated bonus shot is missed and no points are earned, two points are deducted from the team's total score.

In an example embodiment of the disc throwing game, as discussed above, the first team to earn exactly twenty-one points wins. If, when trying to achieve a score of twenty-one, a team earns more than twenty-one points, then that team's score is reduced by the number of points earned in excess of twenty-one. For example, suppose team A has twenty points and only needs one point to reach twenty-one points to win. While intending to slide a disc to hit the opposing target to earn a single point to win, a team member of team A inadvertently slides a disc into the cut out of the opposing target. Since sliding the disc into the cut out of the opposing target earns three points, team A will lose two points for a total of eighteen points. It should be appreciated that the disc throwing game utilizing disc game assembly 10 can incorporate any point scoring scheme.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

REFERENCE NUMERALS

1 typical table
2 top surface
10 disc game assembly
20 target
21 open top
22 open bottom
23 cut out
23A side
23B side
23C side
24 tab
25 tab
26 slot
28 slot
30 target
40 flexible member
41 end
42 end
50 flexible member
51 end
52 end
60 disc
61 disc
62 top surface
63 bottom surface
64 side surface
70 side
71 side
72 top side
73 bottom side
$E_1$ edge
$E_2$ edge
$P_1$ player
$P_2$ player
S sidewall
H height
L length
W width

What is claimed is:

1. A tabletop disc game assembly arranged to be positioned upright on a flat surface, comprising:

a first target, said first target comprising:

a first side edge;

a second side edge displaced from and substantially parallel with said first side edge;

a fastening means operatively arranged to abut said first side edge against said second side edge;

a top side edge connecting said first side edge and said second side edge;

a bottom side edge displaced from and substantially parallel with said top side edge, said bottom side edge including a cut out;

a disc operatively arranged to be received within said first target; and, a flexible member arranged to direct said disc into said first target; said flexible member being substantially planar.

2. The tabletop disc game assembly recited in claim 1, wherein when fastened said first target is substantially arcuate.

3. The tabletop game recited in claim 1, wherein when said first target is fastened, said first target includes an open top and an open bottom.

4. The tabletop game recited in claim 1, wherein said first target is made of plastic.

5. The tabletop game recited in claim 1, wherein said first target is made of high density polypropylene.

6. The tabletop game recited in claim 1, wherein said fastening means includes a tab protruding from said first side edge and a slot within said second side edge operatively arranged to receive said tab.

7. The tabletop game recited in claim 1, wherein said disc is arranged to pass through said cut out.

8. The tabletop game recited in claim 1, wherein said disc is circular.

9. The tabletop game recited in claim 1, wherein said flexible member is made of plastic.

10. The tabletop game recited in claim 1, wherein said flexible member is made of high density polypropylene.

* * * * *